United States Patent [19]

McPhail

[11] 4,175,460

[45] Nov. 27, 1979

[54] FELT, BELT, AND FABRIC TRIMMER

[76] Inventor: John D. McPhail, 2125 E. 38th St., Savannah, Ga. 31404

[21] Appl. No.: 890,303

[22] Filed: Mar. 27, 1978

[51] Int. Cl.[2] ..... B26D 3/12

[52] U.S. Cl. ..... 83/856; 83/425; 83/433; 83/434; 83/440

[58] Field of Search ..... 83/425, 425.1, 433, 83/434, 368, 564, 651, 856, 857, 858, 440, 440.1, 441, 922; 162/194, 286

[56] References Cited

U.S. PATENT DOCUMENTS

| | | | |
|---|---|---|---|
| 1,281,373 | 10/1918 | Holmes | 83/922 X |
| 2,316,249 | 4/1943 | Johnson | 83/425 X |
| 2,704,402 | 3/1955 | Czetli | 33/135 |
| 3,543,625 | 12/1970 | Rowland | 83/433 |
| 3,682,031 | 8/1972 | Degelleke | 83/433 |
| 3,890,868 | 6/1975 | Pickler | 83/433 X |

*Primary Examiner*—J. M. Meister

*Attorney, Agent, or Firm*—Jones, Thomas & Askew

[57] ABSTRACT

Trimmer apparatus for trimming the edge of an endless belt of felt, fabric, or other similar material. The apparatus provides quick-release pins for easy removal of the cutting apparatus from the mounting brackets. The mounting brackets are adjustable in both the vertical and horizontal direction to provide the desired knife orientation. A mounting bracket angle retainer maintains the mounting brackets in a perpendicular relationship to one another while still permitting both folding and adjustment of the mounting brackets.

7 Claims, 6 Drawing Figures

FELT, BELT, AND FABRIC TRIMMER

The present invention relates in general to trimmer apparatus, and relates in particular to trimmer apparatus used to trim the edge of an endless belt, such as a felt or fabric belt associated with the manufacture of paper products.

In the manufacture of various paper products, endless belts of felt or fabric are used during various stages of paper production, for example, to squeeze as much water out of the paper as possible before the paper is dried. These belts may range from approximately 90 to 308 inches wide and may be 65 feet in length or longer, depending on the particular machine.

It is an inherent property of these belts that they stretch in width as they are used, due to the repeated passage of the belts between sets of rollers which compress and elongate the belt. When a belt has stretched out of size, the edges of the belt rub and wear on edges of the machine and thereby produce a frayed edge on the belt. The frayed edge also catches on portions of the machine, such as on the belt guide roll paddles, which causes further damage to the belt and also makes it difficult to keep the belt properly aligned on the machine.

There are two possible ways to prevent the edges of a stretched belt from wearing on the edges of the machine. The tension on the belt may be increased to pull in the slack. This method, however, tends to close up the void spaces in the belt which are used for absorbing water. Thus, increasing the tension on the belt makes the belt less efficient at absorbing water and prohibits the machine from being run at maximum efficiency.

The other method is to trim the stretched edge of the belt. Heretofore, this has been done manually by a worker reaching over the moving belt and machinery while holding a knife in his hand. This method is not only dangerous from a worker safety standpoint, but it also usually produces an uneven cut which causes automatic edge-sensing roll guiding equipment to react improperly. Furthermore, it requires one man to hold the knife and another man to operate the machine.

SUMMARY OF THE INVENTION

Speaking generally, the present invention relates to trimmer apparatus for trimming the edge of an endless belt of felt, fabric or other similar material. More specifically, the trimmer apparatus of the present invention is particularly useful for trimming the edge of felt or fabric belts used in association with paper manufacturing machinery. The apparatus includes a foot unit which holds a knife and adjustable mounting brackets so as to permit easy orientation of the knife at a desired position. The knife and foot unit may be easily and quickly disassembled and the mounting bracket swiveled out of the way when not in use.

Accordingly, it is an object of the present invention to provide an improved trimmer apparatus.

It is another object of the present invention to provide trimmer apparatus which is quick, simple and easy to operate.

Another object of the present invention is to provide trimmer apparatus which is relatively safe to operate.

Yet another object of the present invention is to provide trimmer apparatus which may be quickly and easily disassembled.

A further object of the present invention is to provide trimmer apparatus which produces an improved trimming job over previous manual methods.

Still another object of the present invention is to provide trimmer apparatus which has interchangable cutting feet so that a single cutting foot may be moved to different mounting brackets placed at various locations on a machine.

These and other objects, features and advantages will become apparent from a review of the following detailed description of the disclosed embodiment of the invention and the appended drawing and claims.

DETAILED DESCRIPTION OF THE DISCLOSED EMBODIMENT

Figure 1:
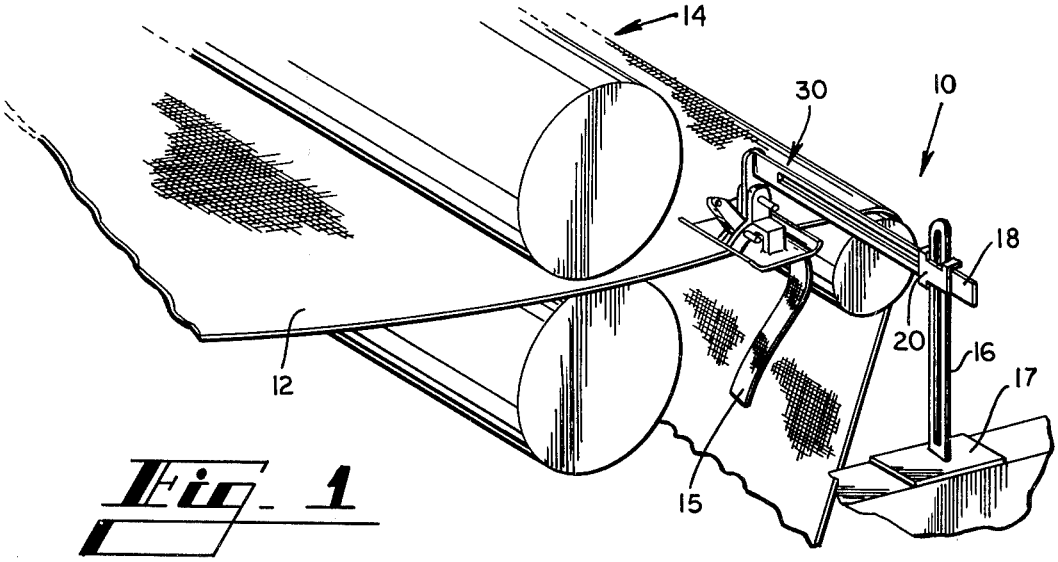
FIG. 1 is a pictorial view of a disclosed embodiment of the trimmer apparatus of the present invention as it would be used with a paper manufacturing machine.
Figure 5:
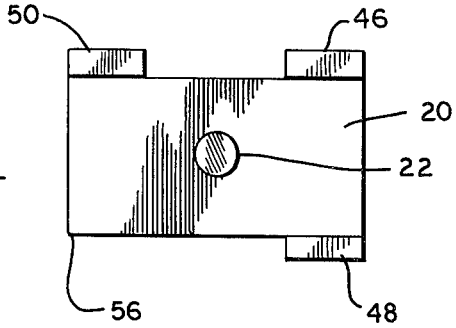
FIG. 5 is a detailed view of the mounting bracket angle retaining plate of the trimmer apparatus shown in FIG. 2.
Figure 2:
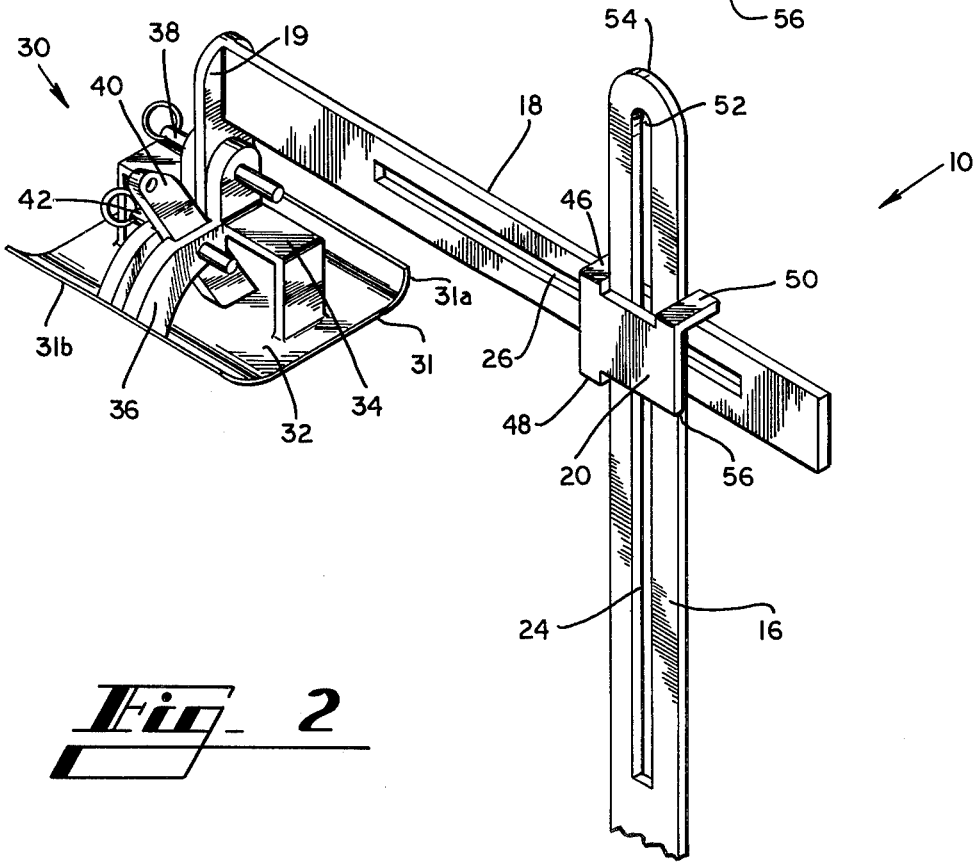
FIG. 2 is a detailed view of the trimmer apparatus shown in FIG. 1.

Referring now to the drawing in which like numbers indicate like elements, it will be seen that there is a trimmer apparatus 10 mounted next to the edge of a typical endless felt belt 12 of a paper manufacturing machine 14 which is only fragmentarily depicted herein. The trimmed edge 15 (FIG. 1) of the felt belt 12 is seen to have been neatly trimmed from the edge of the belt.

Figure 3:
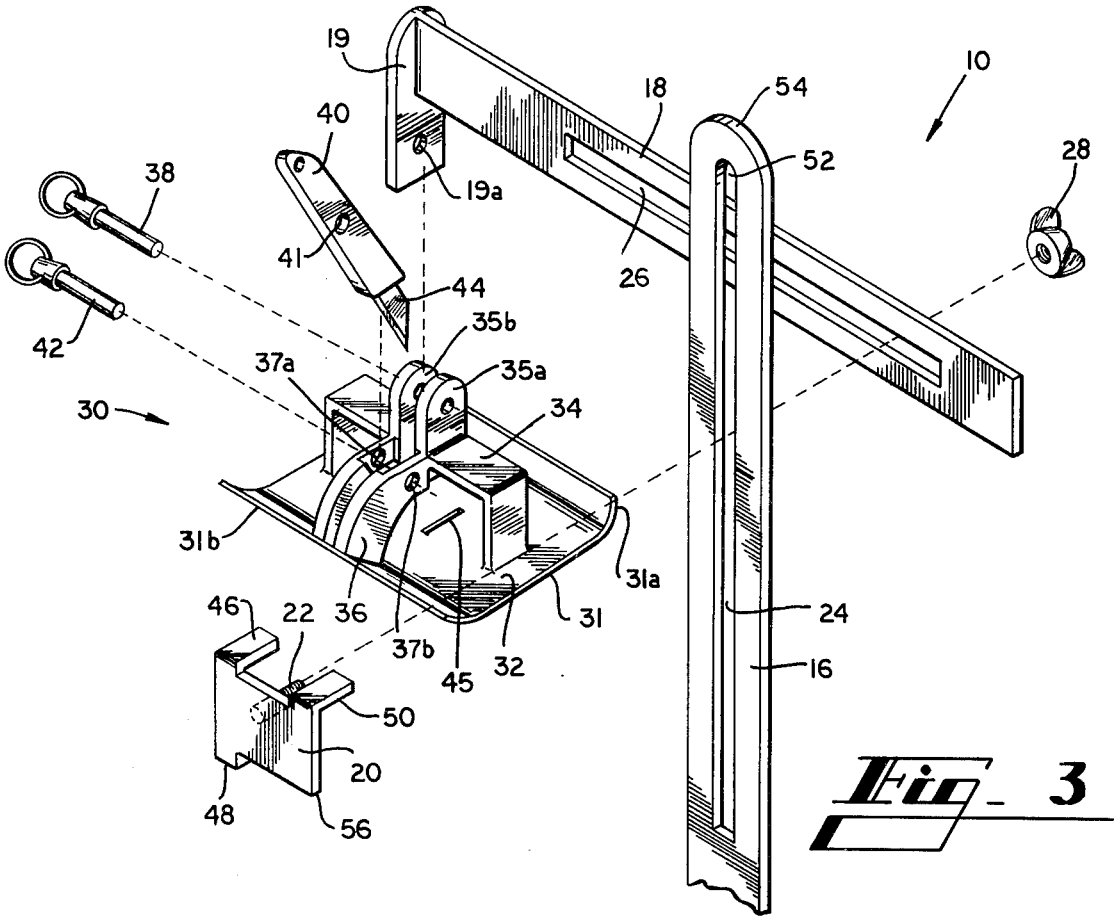
FIG. 3 is an exploded view of the trimmer apparatus shown in FIG. 2.

The lower end of the vertical mounting bracket 16 is securely attached to the frame of the machine by means of a base plate 17. The horizontal mounting bracket 18 is adjustably attached to the vertical mounting bracket 16 by a mounting bracket angle retaining plate 20 having a bolt 22 (see FIG. 3) attached to the center of the plate. The bolt 22 passes through the vertical guide slot 24 of the vertical mounting bracket 16 and through the horizontal guide slot 26 of the horizontal mounting bracket 18. It will therefore be appreciated that the mounting brackets 16 and 18 may be adjusted in relationship to one another in both the vertical and the horizontal direction. When the desired orientation of the mounting brackets is obtained, the mounting brackets may be temporarily secured in that position by tightening the wing nut 28 on the bolt 22.

At one end of the horizontal mounting bracket 18 is the cutting foot assembly 30. The cutting foot assembly 30 includes the sole plate 32, the cutting foot mounting bracket 34 mounted on the upper side of the sole plate, and the knife mounting bracket 36 also mounted on the upper side of the sole plate. The cutting foot assembly 30 is attached to the horizontal mounting bracket 18 by means of a quick release pin 38 which extends through the aligned holes in the tabs **35*a*, 35*b* of the mounting bracket 34 and the hole 19*a* in the tab 19 which extends downwardly from one end of the horizontal mounting bracket 18. The degree of freedom of pivotal movement between the cutting foot assembly 30 and the horizontal mounting bracket 18 is such that only a small amount of angular "float" of the cutting foot assembly is permitted. The angular float permits the plane underside 31 of the cutting foot assembly 30** to adjust to minor variation in the surface of the belt being trimmed.

Figure 6:
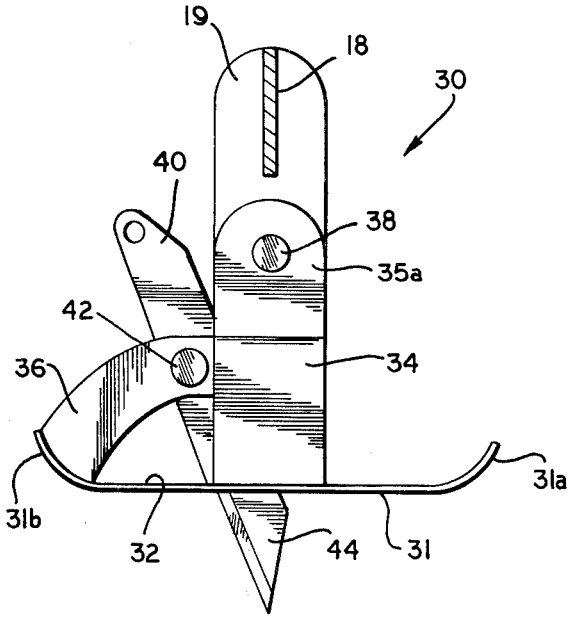
FIG. 6 is a detailed side elevation view of the cutting foot of the trimmer apparatus shown in FIG. 2.
Figure 4:
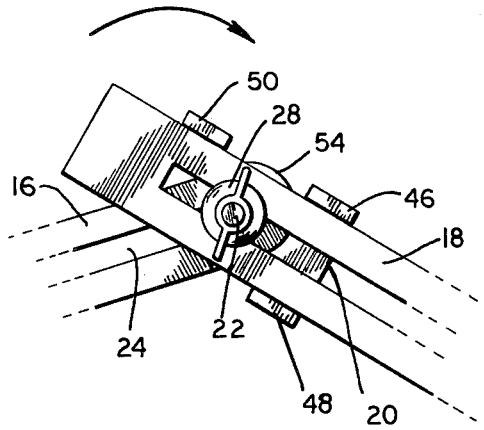
FIG. 4 is a detailed view of the mounting bracket arrangement of the trimmer apparatus shown in FIG. 2.

A conventional trimming knife 40 having a hole drilled therein is attached to the knife mounting bracket 36 by means of a second quick release pin 42 which extends through the knife hole, and through mating holes 37*a*, 37*b* in the two arms of the knife mounting bracket. The knife 40 is mounted on the cutting foot assembly 30 in such a manner that the blade 44 of the knife 40 passes through an aperture 45 in the sole plate 32 and protrudes from the underside of the sole plate, as best shown in FIG. 6. The underside 31 of the sole plate 32 is preferably smooth with its leading edge 31*a* and trailing edge 31*b* slightly turned up so that the sole plate will ride smoothly over the belt being trimmed.

To prevent the horizontal mounting bracket 18 from deviating from the fixed angular relationship with the vertical mounting bracket 16—the angle is preferably a right angle—the retaining plate 20, which engages both the horizontal and vertical mounting brackets, has three mounting bracket guide tabs 46, 48 and 50 attached to the angle corners of the retaining plate. The guide tabs 46, 48 and 50 are spaced from each other so that they closely slidingly contact the edges of the mounting brackets 16 and 18. Thus, tabs 46 and 48 slidingly contact the edges of the horizontal mounting bracket 18 while tabs 46 and 50 slidingly contact the edges of the vertical mounting bracket 16. In this manner, the guide tabs prevent the fixed angle between the mounting brackets from changing while still permitting free sliding movement of the mounting brackets in the vertical and horizontal directions wherever the nut 28 is loosened on the bolt 22.

In operation, the trimmer apparatus is very simple to use. The desired width of the belt being trimmed is set by adjusting the horizontal mounting bracket 18 along the horizontal guide slot 26. The horizontal mounting bracket 18 is adjusted along the vertical guide slot 24 so that the sole plate 32 is resting on the upper surface of the felt belt 12 with the knife blade protruding therethrough. The mounting brackets are then secured in place by tightening the wing nut 28. The machine is then started so that the belt makes its normal circuitous course at a speed suitable for cutting by the knife. After one complete passage of the belt, the edge of the belt will have been completely trimmed off.

It has been found that using the trimmer apparatus of the present invention a complete belt can be trimmed in approximately 3 to 6 minutes compared with a time of approximately 10 to 15 minutes using a hand-held knife. Additionally, using the trimmer apparatus of the present invention a belt can be easily and safely trimmed by one worker, who need not stand over the moving belt.

After the trimming operatoin has been accomplished, the trimmer apparatus may be cleared from the work area in one of three ways: the cutting foot apparatus 30 may be removed from the horizontal mounting bracket 18, the horizontal mounting bracket may be swiveled into a position parallel with the vertical mounting bracket 16, or both of the foregoing may be done.

To remove the cutting foot apparatus 30 from the horizontal mounting bracket 18, the quick release pin 38 is merely removed from the cutting foot mounting bracket 34. The cutting foot assembly may then be removed for storage or it may be taken to another site on the machine and remounted on another mounting bracket.

Alternately, the horizontal mounting bracket 18 may be swiveled out of its normal operating position into a position parallel with the vertical mounting bracket 16. This may be accomplished by loosening the wing nut 28 so that the horizontal mounting bracket 18 is free to slide up and down the length of the vertical guide slot 24. The horizontal mounting bracket 18 is then slid to the upper reaches of the vertical guide slot 24 until the bolt 22 reaches the end 52 of the vertical guide slot. When in this position, it is possible to rotate the horizontal mounting bracket 18 to a position parallel to the vertical mounting bracket 16. This is possible because the distance between the bolt 22 and the guide tab 46 is greater than the distance from the end 52 of the vertical guide slot 24 to the end 54 of the vertical mounting bracket 16, and because there is not a fourth guide tab at the corner 56 of the retaining plate 20. To further facilitate the rotation of the horizontal mounting bracket 18, the end 54 of the vertical mounting bracket 16 is rounded. After the horizontal mounting bracket 18 has been rotated into the parallel position, the retaining plate 20 and the bolt 22 may be lowered to the midpoint of the vertical guide slot 24 and the combination of the horizontal mounting bracket and the vertical mounting bracket 16 reduced to its shortest possible combined length.

Of course, it is possible to rotate the horizontal mounting bracket 18 to the parallel position as described above with or without the cutting foot assembly 30 in place. However, it is preferable to remove the cutting foot assembly 30 whenever the trimmer apparatus is not in use, from a safety standpoint and also to prevent any accidental damage to the cutting foot.

It has been found that when a conventional cutting knife, such as a Stanley No. 199, is used it is necessary to change the blade of the knife only infrequently. However, the knife 40 may be easily removed from the cutting foot assembly 30 by withdrawing the second quick release pin 42. The knife 40 may then be removed and the blade changed in the usual manner.

The various members of the trimmer apparatus may be made of any suitable material which will sustain the various mechanical forces placed thereon. However, since the typical environment in which the trimmer apparatus will be used is humid and includes chemicals which promote the deterioration of many metals, it is preferred that the apparatus be constructed of a corrosion resistant material such as stainless steel. Additionally, the size and strength of the various parts of the apparatus may be varied depending on the type of material being trimmed.

It should be understood, of course, that the foregoing relates only to a preferred embodiment of the present invention and that numerous modifications or alterations may be made therein without departing from the spirit and the scope of the invention as set forth in the appended claims.

What is claimed is:

1. Trimmer apparatus for trimming the edges of an endless belt, said apparatus comprising:

first bracket bar means for attachment of said trimmer apparatus to a machine;

second bracket bar means for attachment to said first bracket bar means;

foot means removably attached to said second bracket bar means and having a region which selectably contacts a belt to be trimmed;

knife means removably attached to said foot means in operative relation to cut a belt which is contacting said region and moving relative to said region; and means for maintaining the angular relationships of said first bracket bar means to said second bracket bar means while allowing slidable adjustment of said second bracket bar means along at least a portion of the length of said first bracket bar means.

2. Trimmer apparatus as in claim 1, wherein;

said foot means comprises sole plate means;

said knife means comprises a blade which projects through said sole plate means;

first means for removably attaching said knife means to said sole plate means; and second means for removably attaching said sole plate means to said second bracket bar means.

3. Trimmer apparatus as in claim 1, wherein said angular maintaining means allows slidable adjustment of said first bracket bar means along at least a portion of the length of said second bracket bar means.

4. Trimmer apparatus as in claim 1, further comprising adjustable bracket bar attachment means for adjustable attachment of said first bracket bar means to said second bracket bar means.

5. Trimmer apparatus for trimming the edge of an endless belt, said apparatus comprising:

a first mounting bracket means having a longitudinal slot therein;

a second mounting bracket means having a longitudinal slot therein;

means operatively engaging first and second mounting bracket means to maintain a predetermined fixed angular relation therebetween while allowing slidable adjustment of said mounting bracket means along said longitudinal slots;

sole plate means;

knife means with the blade of said knife means projecting through said sole plate means;

first pin means for removably attaching said knife means to said sole plate means; and second pin means for removably attaching said sole plate means to said second mounting bracket means.

6. Trimmer apparatus as in claim 5, wherein said means operatively engaging said first and second mounting bracket means comprises:

plate means having tabs at three of the corners of said plate means; said tabs engaging the edges of said first mounting bracket means and said second mounting bracket means so as to maintain the angular relationship between said mounting bracket means; and securement means attached to said plate means, said securement means adjustably securing said first mounting bracket means to said second mounting bracket means so as to permit adjustment along the length of said longitudinal slots of said first mounting bracket means and said second mounting bracket means.

7. Trimmer apparatus for trimming the edge of an endless belt, said apparatus comprising:

first bracket bar means for attachment of said trimmer apparatus to a machine;

second bracket bar means for attachment to said first bracket bar means;

foot means removably attached to said second bracket bar means and having a region which selectably contacts a belt to be trimmed;

knife means removably attached to said foot means in operative relation to cut a belt which is contacting said region and moving relative to said region;

adjustable bracket bar attachment means for adjustable attachment of said first bracket bar means to said second bracket bar means; and angle retaining means for maintaining the angular relationship of said first bracket bar means to said second bracket bar means, said angle retaining means having a plurality of tabs which engage edges of said first and second bracket bar means and thereby maintain said first and second bracket bar means in a fixed angular relationship when thereby engaged.

* * * * *